United States Patent [19]

Stone et al.

[11] 4,342,973

[45] Aug. 3, 1982

[54] SOLENOID ANNUNCIATOR

[75] Inventors: Richard S. Stone, Palatine; Morris Chercasky, Chicago, both of Ill.

[73] Assignee: Guardian Electric Manufacturing Company, Chicago, Ill.

[21] Appl. No.: 180,677

[22] Filed: Aug. 25, 1980

[51] Int. Cl.[3] ..... H01H 47/00; H01F 7/18; G08B 21/00

[52] U.S. Cl. ..... 335/2; 335/187; 335/126; 340/644; 340/654

[58] Field of Search ..... 335/126, 133, 187, 196, 335/2, 115, 192; 340/635, 641, 644, 654

[56] References Cited

U.S. PATENT DOCUMENTS 3,922,625 11/1975 Hall ..... 335/196

*Primary Examiner*—L. T. Hix
*Assistant Examiner*—S. D. Schreyer
*Attorney, Agent, or Firm*—Allegretti, Newitt, Witcoff & McAndrews

[57] ABSTRACT

An annunciator for a solenoid includes a conductive probe which projects into the pathway of the solenoid core piece. Upon actuation of the core piece, the probe is engaged by the core piece to partially complete an electrical circuit to an external signalling device. The probe includes a lost motion contact to insure proper making and breaking of a circuit upon further movement of the core piece into engagement with the field piece.

4 Claims, 3 Drawing Figures

SOLENOID ANNUNCIATOR

BACKGROUND OF THE INVENTION

This invention relates to a solenoid device and more particularly to an annunciator for detecting solenoid actuation.

Electrically actuated solenoids are very useful for generating a mechanical output in response to an electrical input. Typically, such devices are used to control mechanical latching and unlatching, mechanical counters and various other mechanically actuated devices.

On occasion, activation of a solenoid coil by passing current through the coil may not result in proper mechanical input or movement of a core piece actuator associated with the solenoid. Detecting such deficiencies in a complex, electromechanical device may require an experienced repair man. "Trouble shooting" for failures due to solenoid inoperativeness may therefore be an expensive and time consuming undertaking.

To alleviate such problems, solenoid annunciators have been proposed. Such annunciators provide an indication that the solenoid has translated properly in response to coil activation or deactivation. Thus, an annunciator may comprise a mechanically operated limit switch which is driven by the core piece. The present invention relates to an improved annunciator which is characterized by the simplicity of its construction, the economy of its size and manufacture, and its ability to be incorporated as part of existing solenoid designs.

SUMMARY OF THE INVENTION

Briefly, the present invention is an annunciator incorporated in a typical solenoid device. A typical solenoid device includes a field piece having a bobbin mounted thereon. The coil is wrapped on the bobbin and a core piece is mounted in an axial passage defined by the bobbin. The annunciator is comprised of an insulated probe projecting into the interior core piece passage of the bobbin. The annunciator includes a spring biased plunger which may be engaged upon appropriate movement of the core piece which occurs in response to current flow through the coil. Further movement of the core piece causes engagement thereof with the field piece. When this occurs, a circuit is made or broken. Contact of the core piece with the plunger and then with the field piece closes an electric indicator circuit. The closed circuit provides an electrical readout indicative of proper operation of the solenoid.

Thus, it is an object of the present invention to provide an improved solenoid annunciator.

A further object of the present invention is to provide a solenoid annunciator which is economical to manufacture, easy to use and reliable over a long period of time.

Still a further object of the present invention is to provide a solenoid annunciator which may be incorporated into the designs of existing solenoid devices.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
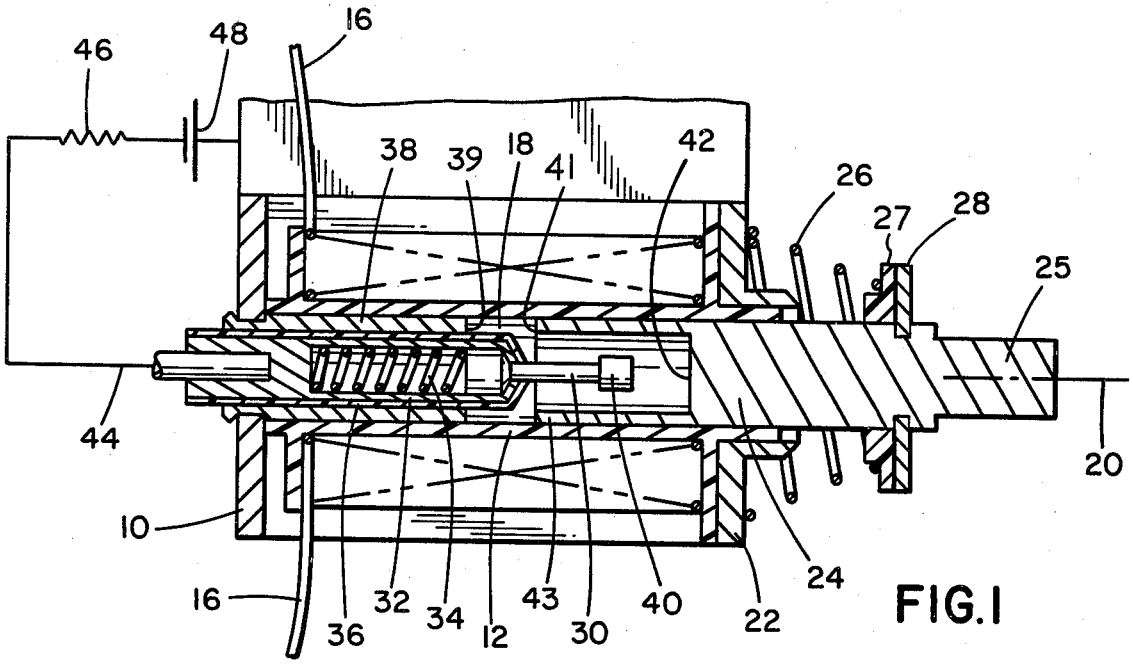
FIG. 1 is a side cross sectional view of a solenoid which includes the improved annunciator of the present invention.
Figure 2:
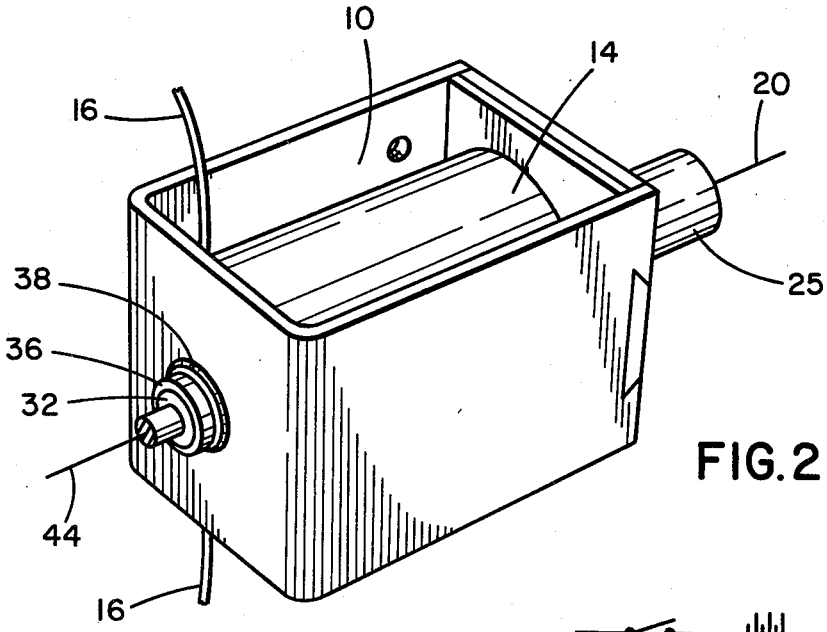
FIG. 2 is a perspective view illustrating the annunciator construction of the present invention.

The annunciator of the present invention is incorporated within a typical solenoid device of the type illustrated in the figures. Thus, referring to the figures, a solenoid device includes a U-shaped field piece 10 which is cooperative with a coil bobbin 12. The field piece 10 is normally fabricated from a conductive material such as a steel, sheet material. The bobbin 12 is normally constructed from an insulating material such as a fiber board or a plastic material. A coil 14 is wound on bobbin 12. Coil leads 16 connect to the coil 14.

The bobbin 12 defines a generally cylindrical center passage 18 having a longitudinal axis 20. A field plate 22 is staked across the open ends of the field piece 10. The plate 22 maintains the bobbin 12 in position as illustrated between the legs of the field piece 10.

A solenoid core piece 24 is positioned within the passage 18 and is translatable along the coil axis 20 in response to current passing through coil 14. A spring 26 biases against an insulating ring 27 retained by a C-shaped washer 28 affixed to the end of the cylindrical core piece 24 to force the core piece 24 toward an axially extended position as illustrated in FIG. 1. Current flux through the coil 14 will cause the core piece 24 to translate to the left in FIG. 1 against the biasing force of the spring 26.

The external end 25 of the core piece 24 is typically attached to a mechanical actuator of some sort in order to effect a switching action or other action in response to current through the coil 14. The solenoid so far described constitutes a typical solenoid construction which has been heretofore available.

The annunciator of the present invention constitutes a method for determining whether the core piece 24 has, in fact, been appropriately translated in response to current through coil 14. The annunciator includes a spring biased plunger 30 slidably mounted within a housing 32. Plunger 30 is biased by a spring 34 axially toward the core piece 24. The housing 32 is surrounded by or encapsulated in an insulating tube 36 which separates the housing electrically from the field piece 10. Thus, the housing 32 is electrically insulated from the remainder of the solenoid.

A fixed core piece cylinder 38 surrounds the tube 36 and the housing 32. Cylinder 38 extends from the field piece 10 toward the core piece 24 to improve the magnetic circuit of the solenoid. Cylinder 38 is also positioned to mechanically and electrically engage the core piece 24 as described below.

Thus, in the preferred embodiment the plunger 30 includes a contact end 40 shaped to fit within a counterbore 42 defined in the core piece 24. Counterbore 42 defines a counterbore flange 43. The contact end 40 of plunger 30 is normally separated from the counterbore 42 so that no electrical circuit is completed through the core piece 24 and plunger 30.

However, upon proper actuation of the core piece 24, the core piece 24 will traverse to the left in FIG. 1 along axis 20 to engage the bottom of counterbore 42 with contact end 40 of plunger 30. The plunger 30 will then traverse slightly further to the left in FIG. 1 upon contact with the core piece 24, there providing a "lost motion". As a consequence, the flange 43 and cylinder 38 or more particularly surfaces 41 and 39, respectively, will contact providing a closed electrical circuit to be completed in the manner illustrated in FIG. 3. Namely, a contact lead 44 to the housing 32 through a signal resistor 46 in a circuit with a power source 48 will provide a closed circuit when the opposite side of the power source 48 is connected to the field piece 10. The circuit is completed through cylinder 38, flange 43 of core piece 24 and thence through plunger 40.

Figure 3:
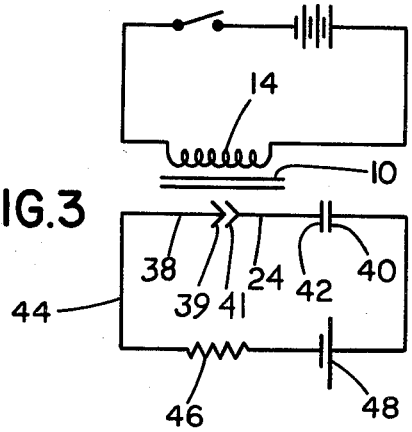
FIG. 3 is a circuit diagram of the annunciator of the present invention.

In this manner, it is possible to obtain a clear indication that the solenoid has been actuated in an appropriate manner upon passage of current to the coil 14. Importantly, the plunger 30, in combination with spring 34 and housing 32, provide a lost motion or moving contact between the contact end 40 and core piece 24 thereby insuring a continuous annunciation signal upon final closing of the circuit by contact of cylinder 38 and flange 43. FIG. 3 is a circuit diagram illustrating these features.

With the described structure of the present invention it is possible to incorporate an annunciator as depicted with numerous types of existing solenoid devices. The annunciator gives a quick and dependable confirmation that the solenoid device is providing a proper mechanical output. Therefore, when repairing or otherwise troubleshooting a complex electromechanical device, an instant indication of the proper operation of a solenoid device can be obtained. It is, of course, possible to vary the structure of the present invention without departing from these basic concepts. The invention is therefore to be limited only by the following claims and their equivalents.

What is claimed is:

1. A solenoid annunciator comprising, in combination;

a solenoid field piece;

a solenoid bobbin mounted on the field piece, said bobbin having a central passage, said passage defining a longitudinal axis;

an annular solenoid coil on the bobbin;

a movable core piece mounted in the passage for translation axially in response to flux in the coil; and a contact mechanism projecting into the passage axially from one end of the bobbin, said contact mechanism being electrically insulated from the moveable core piece and projecting into the path of movement of the moveable core piece, said contact mechanism including lost motion means operative by engagement of the moveable core piece to provide continuous electrical contact with the moveable core piece upon coil actuation and travel of the core piece, said contact mechanism including a conductive plunger projecting axially toward the moveable core piece, electrically conductive biasing means acting on the plunger to bias the plunger toward the moveable core piece, and mounting means for supporting the biasing means and plunger, said conductive plunger being biased towards the moveable core piece.

2. The annunciator of claim 1 including external circuit detection means connected between the contact mechanism and the field piece, an annunciator circuit being completed through the field piece to the core piece upon completion of said coil actuation.

3. The annunciator of claim 1 wherein the mounting means comprise a hollow, generally cylindrical housing mounted in the field piece, and said biasing means comprise a coil spring mounted within the housing, said plunger also slidably mounted in the housing and projecting from the housing for cooperation with the core piece.

4. The annunciator of claim 1 including core piece biasing means for biasing the core piece to a projected position in opposed relation to movement imparted by current flow in the coil.

* * * * *